US007287535B2

(12) United States Patent
Kataoka

(10) Patent No.: US 7,287,535 B2
(45) Date of Patent: Oct. 30, 2007

(54) WORK WASHING APPARATUS

(75) Inventor: Keiji Kataoka, Okazaki (JP)

(73) Assignee: Fine Machine Kataoka Co., Ltd., Anjo-shi (JP)

( * ) Notice: Subject to any disclaimer, the term of this patent is extended or adjusted under 35 U.S.C. 154(b) by 547 days.

(21) Appl. No.: 10/426,701

(22) Filed: May 1, 2003

(65) Prior Publication Data

US 2004/0216773 A1 Nov. 4, 2004

(51) Int. Cl.

| | |
|---|---|
| ***B08B 3/00*** | (2006.01) |
| ***B08B 1/02*** | (2006.01) |
| ***B08B 3/04*** | (2006.01) |
| ***B08B 3/12*** | (2006.01) |
| ***B08B 6/00*** | (2006.01) |

(52) U.S. Cl. ..... 134/95.3; 134/26; 134/32; 134/34; 134/74; 134/94.1; 134/111; 134/123; 134/126; 134/130; 134/133; 134/134; 134/199

(58) Field of Classification Search ..... 134/71, 134/94.1, 95.3, 111, 126, 130, 134, 26, 123, 134/32, 34, 74, 199, 133
See application file for complete search history.

(56) References Cited

U.S. PATENT DOCUMENTS

| | | | | |
|---|---|---|---|---|
| 3,902,513 A | * | 9/1975 | Franz | 134/151 |
| 4,857,113 A | * | 8/1989 | Hodge | 134/32 |
| 5,266,123 A | * | 11/1993 | Brand | 134/26 |
| 6,032,311 A | * | 3/2000 | Nambu | 15/3.15 |
| 6,129,099 A | * | 10/2000 | Foster et al. | 134/57 R |

FOREIGN PATENT DOCUMENTS

| | | |
|---|---|---|
| JP | 31-17724 | 11/1956 |
| JP | 60-102990 | 6/1985 |
| JP | 3-45569 | 9/1991 |
| JP | 3-221177 | 9/1991 |
| JP | 4-22081 | 2/1992 |
| JP | 6-226220 | 8/1994 |
| JP | 7-31575 | 2/1995 |

* cited by examiner

*Primary Examiner*—Michael Barr
*Assistant Examiner*—Rita R Patel
(74) *Attorney, Agent, or Firm*—Westerman, Hattori, Daniels & Adrian, LLP.

(57) ABSTRACT

A work washing apparatus including a transfer unit for controlling forward and rearward movements of a work, a table moved by the transfer unit, carrying out the washing of the work from upper and lower surfaces thereof and provided with water/air pipes, an upper surface washing unit provided on an upper surface of the transfer unit and having upper surface washing nozzles which make planetary movements by utilizing rational movements of the nozzles on their own axes and an orbital movement of the washing unit, side surface washing units provided on both side surfaces of the transfer unit and having side surface nozzles which make planetary movements by utilizing rotational movements of the nozzles on their own axes and an orbital movement of the upper surface washing unit, a lower washing unit provided on a lower surface of the transfer unit and having lower surface washing nozzles which make planetary movements by utilizing rotational movements of the nozzles on their own axes and an orbital movement of the washing unit, and a device for supplying water and/or air to each nozzle.

1 Claim, 9 Drawing Sheets

WORK WASHING APPARATUS

BACKGROUND OF THE INVENTION

1. Field of the Invention

This invention relates to a work washing apparatus.

2. Description of the Invention

Related art work washing method and apparatus were constituted by determining work washing points in advance, providing a multiplicity of nozzles directed to these work washing points, blowing out water and/or air from the multiplicity of nozzles onto the works, and thereby washing and drying the work. Therefore, a number of nozzles are needed, and this causes the work washing apparatus and pipes to be complicated and enlarged, or the maintenance and management of the washing apparatus and pipes to be complicated. In other words, providing a number of nozzles in the washing apparatus causes the apparatus to be complicated and enlarged, or the maintenance and management thereof to become complicated.

The method and apparatus for solving this problem will now be described with reference to literature (1) to (3). The literature (1) is JP-A-7-31575 disclosing a rotary nozzle apparatus and a method of designing the same. This invention uses a nozzle formed by a plurality of links, and an angle of water injected from an injection port of the nozzle is varied randomly by using a chaos principle. The water is injected randomly from the nozzle by utilizing this variation of injection angle. One of the objects of the invention resides in the washing of a work efficiently and speedily by utilizing the uniform injection and diffusion of water from the nozzle. The literature (2) is JP-A-6-226220 disclosing a washing apparatus. This invention is provided with a pair of nozzles adapted to be moved orbitally and rotated on their own axes in the horizontal direction by utilizing support arms; and formed so that a washing liquid and/or warm water is diffused by these two nozzles. One of the objects of this invention resides in the washing of parts of a metering apparatus, such as a hopper efficiently and beautifully by utilizing a small number of nozzles. The literature (3) is JP-UM-B-3-45569 disclosing an injection nozzle moving unit in a pearl oyster shell washing machine. This invention is formed by meshing a smaller gear rotating on its own axis with a larger gear moving orbitally around a main shaft, and providing a nozzle-carrying branch pipe on the smaller gear. One of the objects of this invention resides in the execution of a wide range washing operation utilizing a smaller gear which rotates on its own axis on an orbitally moving larger gear, and the attainment of an efficient washing operation.

To sum up the inventions disclosed in the literature (1) to (3), important points reside in the provision of the orbitally moving links and links rotating on their own axes both of which links are mounted on a main shaft, the provision of a plurality of nozzles on the links, the diffusing of washing water in a wide range, the contriving of an efficient washing operation, and the attaining of an efficient washing operation by utilizing orbital movement and rotation on the own axes of the nozzles (the nozzles moving orbitally and the nozzles rotating on their own axes). However, the nozzles moving orbitally and nozzles rotating on their own axes are formed so as to utilize their horizontal (planar) orbital movements and horizontal (planar) movements thereof on their own axes.

Therefore, the inventions disclosed in the literature (1) to (3) cannot wash in all directions objects (works) to be washed, such as works, processed goods and products. These inventions cannot wash works in all directions either in a place to which the works are fed. The inventions disclosed in the literature (1) to (3) wash upper, lower and side surfaces of a work separately, so that it is understood that these inventions are improved as compared with older apparatuses of this kind. However, in order to provide nozzles on various portions of the inventions disclosed in the literature (1) to (3), a large number of nozzles are needed, and this causes the washing apparatuses and pipes to be complicated and enlarged, and the maintenance and management thereof to be complicated. In other words, providing a multiplicity of nozzles in a washing apparatus causes the apparatus to be complicated and enlarged, or the maintenance and management of the apparatus to be complicated.

SUMMARY OF THE INVENTION

In view of the above-described circumstances, the present invention provides a work washing apparatus capable of washing upper, lower and side surfaces of a work substantially at once and in all directions by utilizing a multiplicity of nozzles provided on these surfaces; simplifying and miniaturizing the washing apparatus and pipes and making easier the maintenance and management thereof by utilizing an all-direction washing operation; simplifying and miniaturizing the washing apparatus or making easier the maintenance and management thereof by providing a multiplicity of nozzles on many sides of the washing apparatus; improving a washing efficiency; reducing the time needed for a washing operation; and handling the washing apparatus more easily.

The invention has a transfer unit for controlling forward and rearward movements of a work, a table provided with water/air pipes used to wash and dry the whole surface of the work moved by the transfer unit, an upper surface washing unit provided on an upper surface of the transfer unit and having upper surface washing nozzles, side surface washing units provided on both side surfaces of the transfer unit and having side surface washing nozzles, a lower surface washing unit provided on a lower surface of the transfer unit and having lower surface washing nozzles, and a device for supplying water and/or air to each nozzle, the upper surface washing unit including a freely rotatable main shaft provided on a frame, a driving unit and a transmission unit for controlling a rotation of the main shaft, a rotary plate mounted on the main shaft, a rotary shaft provided vertically on the rotary plate, a gear mounted on the rotary shaft and a gear mounted on a sleeve fastened to the frame both of which gears are meshed with each other to cause the rotary shaft to be rotated, horizontal shafts provided on the rotary plate, sprockets mounted on the horizontal shafts, upper surface nozzle links mounted on the rotary shaft, the driving device for controlling the rotations of the upper surface nozzle links, and upper surface washing nozzles provided on the upper surface nozzle links, the side surface washing unit including support rods provided on the rotary plate of the upper surface washing unit, rotary shafts provided on the support rods, sprockets connected to the sprockets in the upper surface washing unit, which rotate these rotary shafts, via chains, side surface nozzle links mounted on the rotary shafts, and a pair of side surface washing nozzles provided on the side surface nozzle links, the lower surface washing unit including a vertical rotatable shaft provided on the frame, a rotating device for controlling a rotation of this vertical shaft, a rotary plate mounted on the vertical shaft, a rotary shaft provided on the rotary plate, lower surface nozzle links mounted on this rotary shaft, a rotating device for controlling a rotation of the lower surface nozzle links, and lower surface washing nozzles provided on the lower nozzle links.

BRIEF DESCRIPTION OF THE DRAWINGS

A preferred embodiment of the invention will now be described with reference to the accompanying drawings, wherein.

DESCRIPTION OF THE PREFERRED EMBODIMENT

Figure 1:
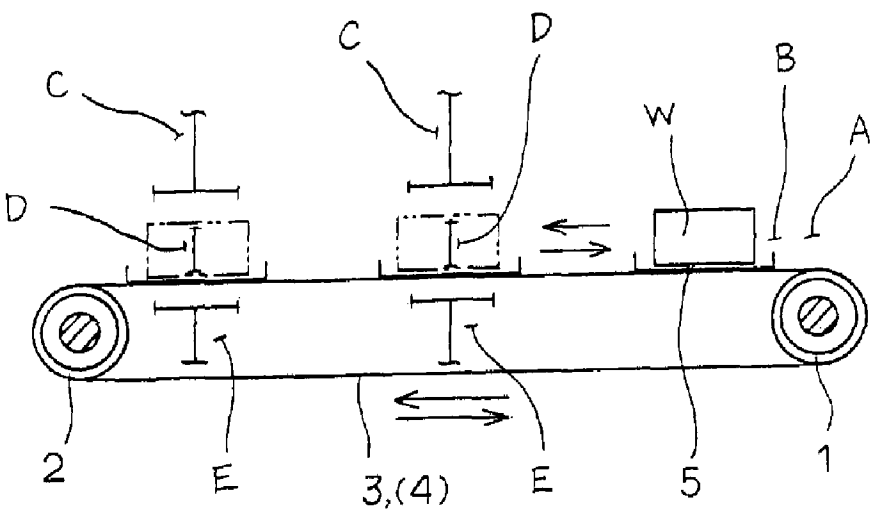
FIG. 1 is a side view illustrating the outline of the present invention.
Figure 2:
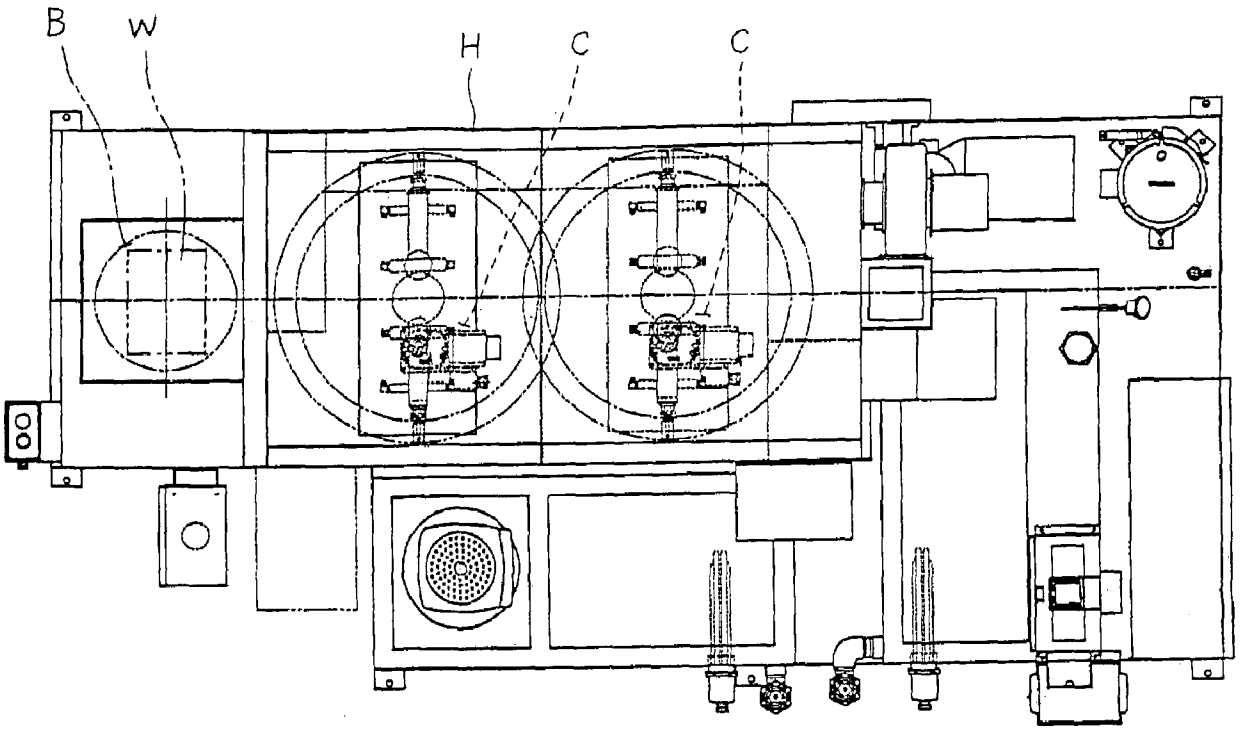
FIG. 2 is a schematic plan view showing the present invention.
Figure 3:
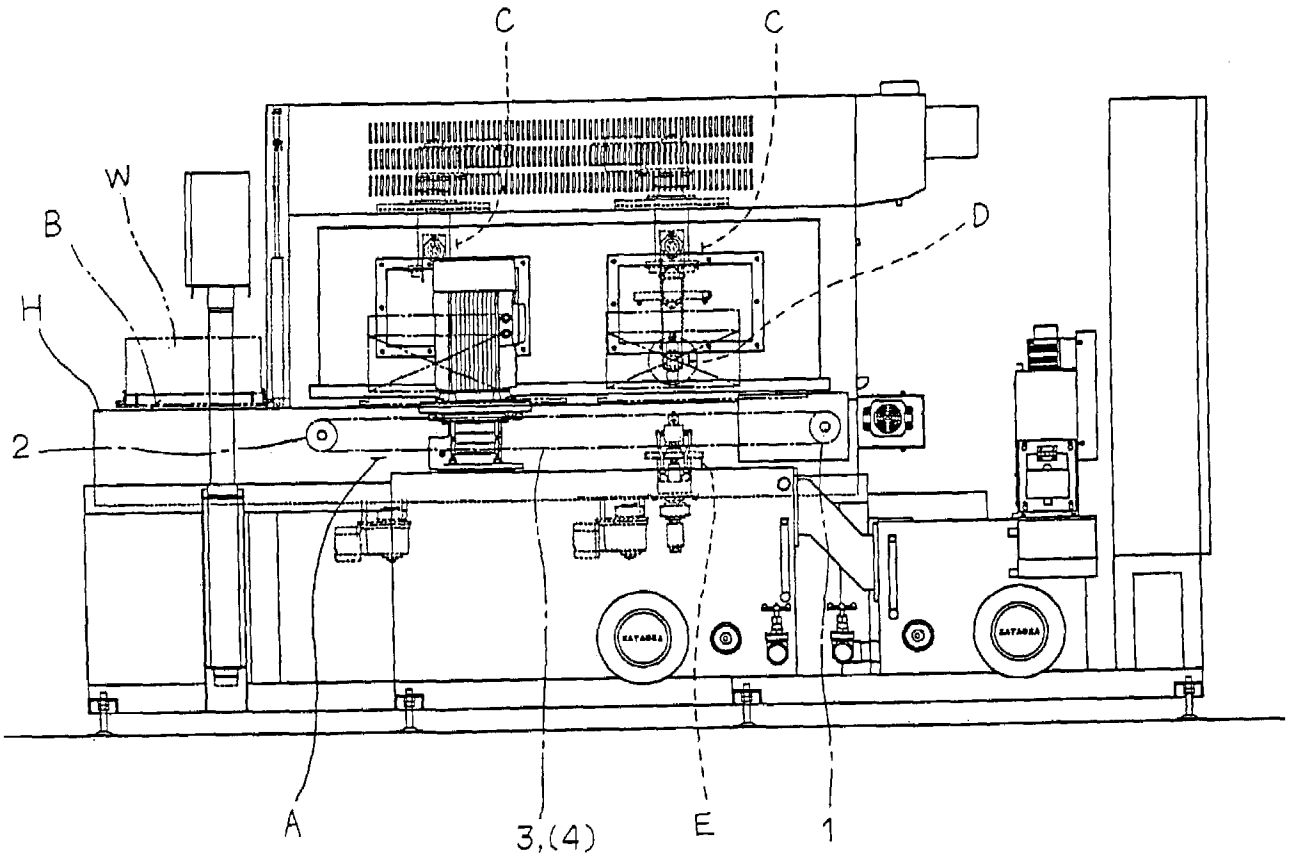
FIG. 3 is a schematic side view showing the present invention.
Figure 4:
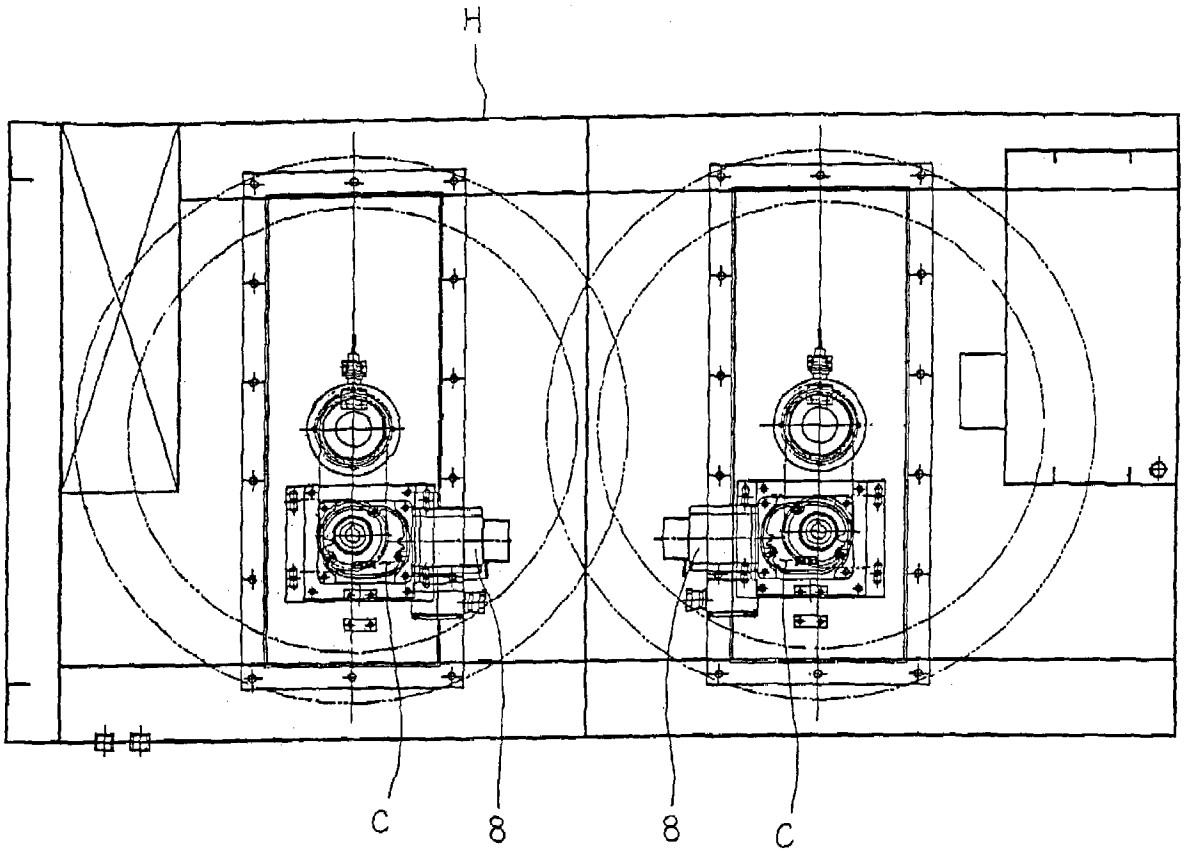
FIG. 4 is a plan view of a principal portion.
Figure 5:
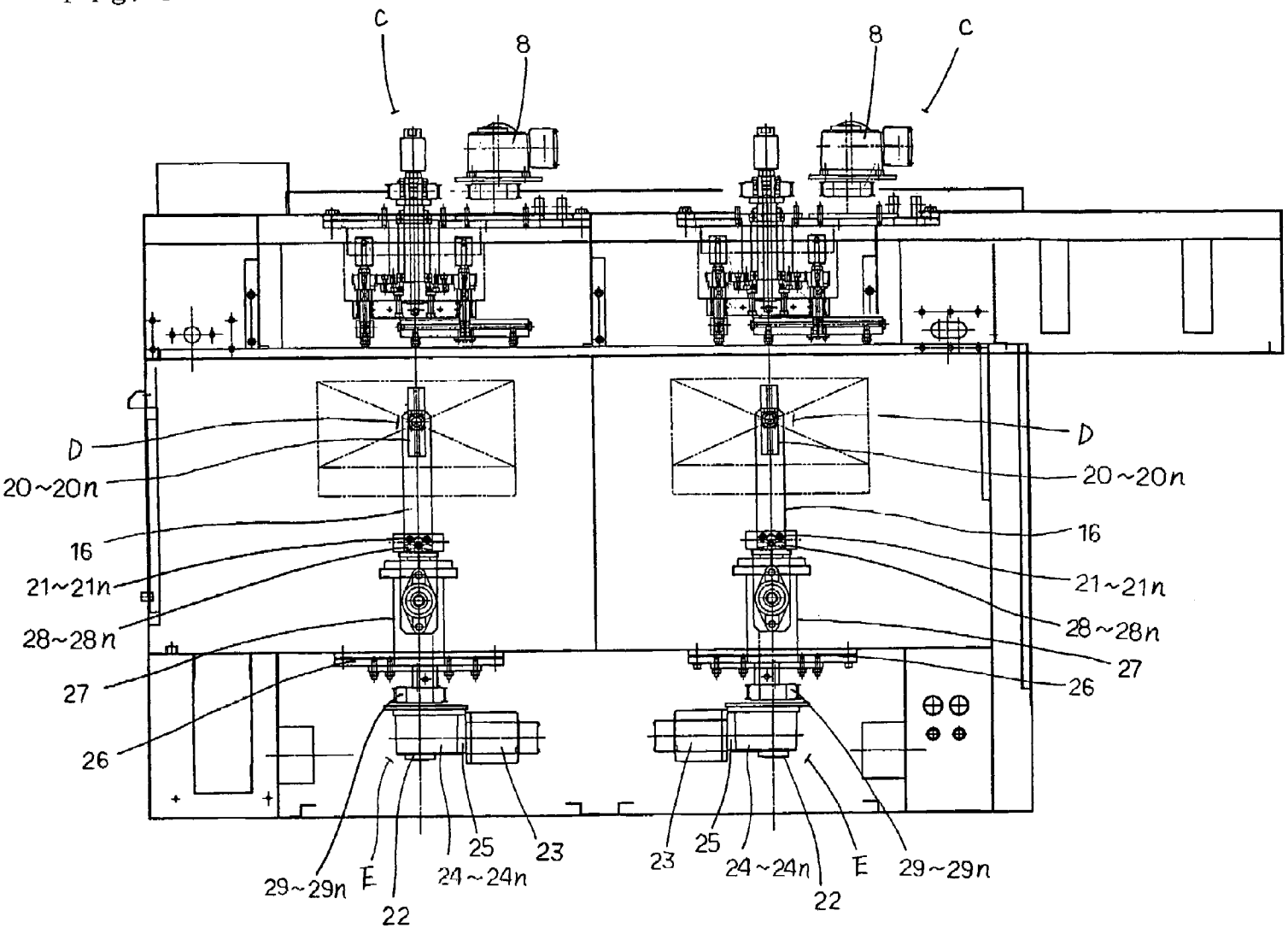
FIG. 5 is a sectioned side view of a principal portion.
Figure 6:
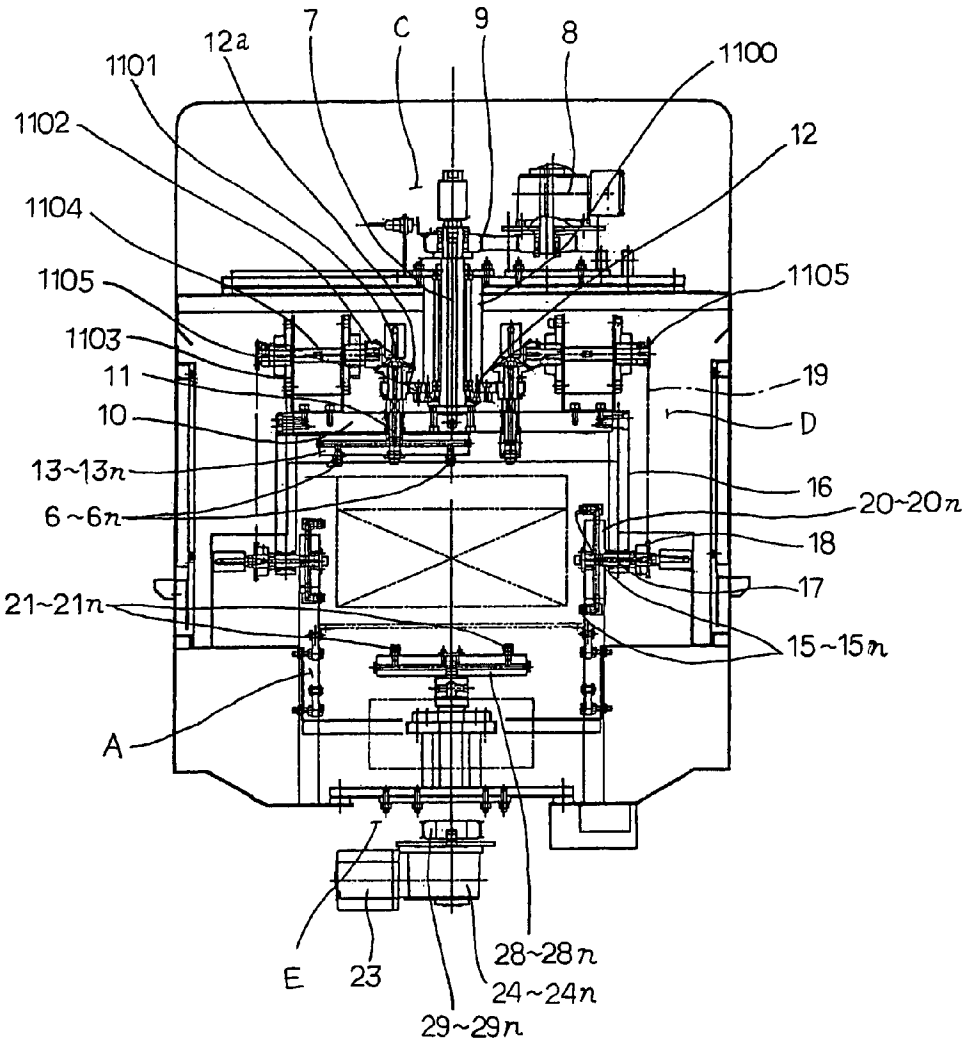
FIG. 6 is a sectioned front view of a principal portion.
Figure 7:
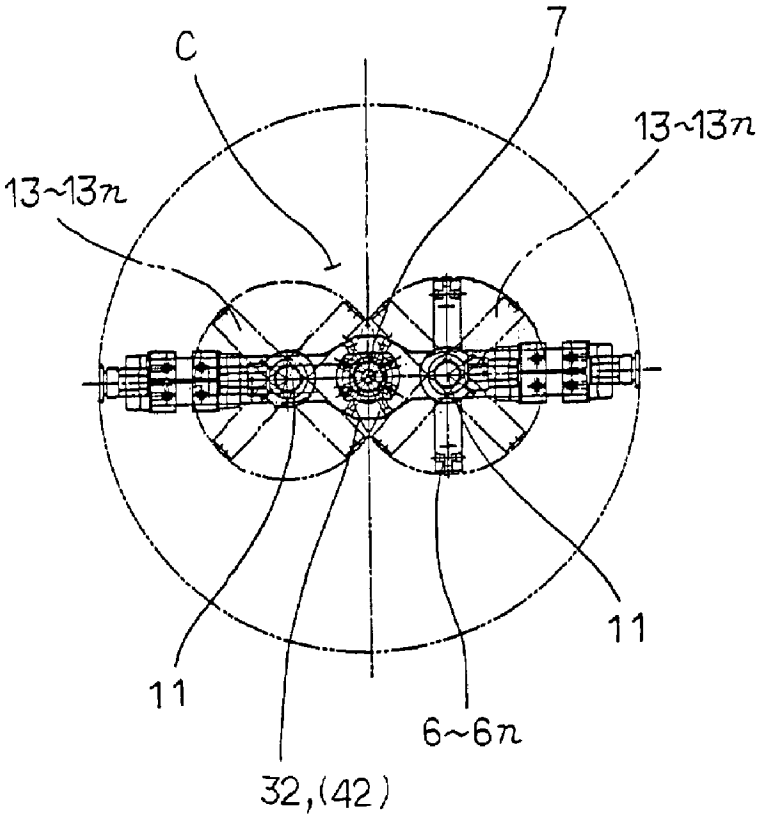
FIG. 7 is a sectioned plan view of an upper surface washing unit.
Figure 8:
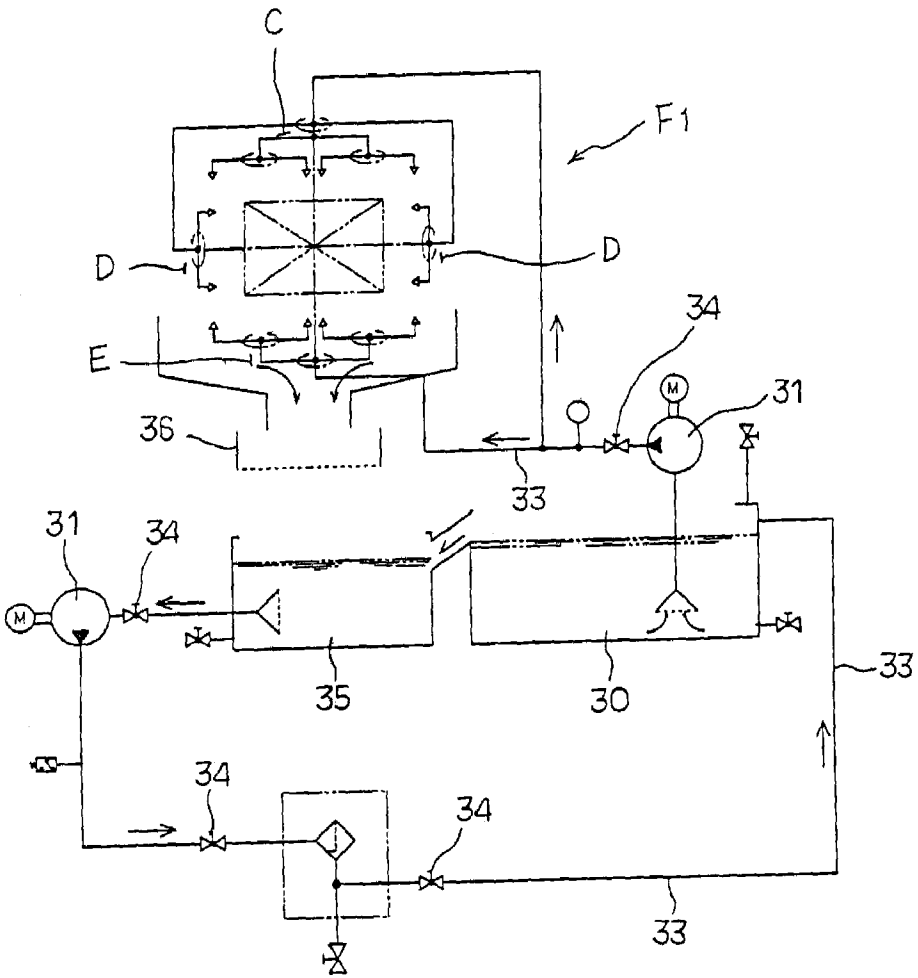
FIG. 8 is a schematic diagram illustrating the supplying of water.
Figure 9:
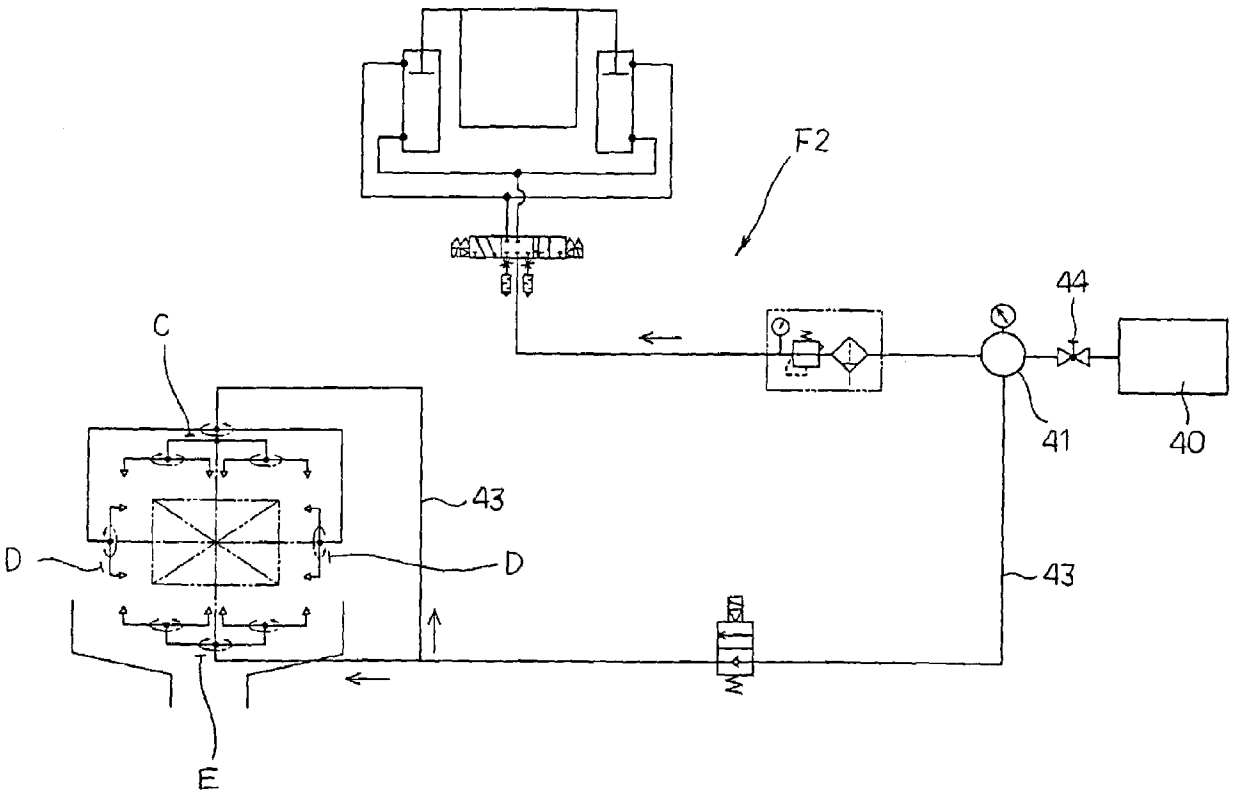
FIG. 9 is a schematic diagram illustrating the supplying of air.

An example of a work washing operation will now be described. A work is placed (set) on a table which is positioned in a carry-in port of a transfer unit provided in this washing apparatus, and which is formed so that water and/or air can pass the table. After the work is placed on the table, the transfer unit is operated, and moves the work and table to a washing position, the work and table being stopped at a first predetermined position (first position) by utilizing a detecting device, such as a limit switch. After the work and table are stopped, the work is washed in all directions thereof by utilizing the injection of water from the nozzles of an upper surface washing unit, the injection thereof from those of side surface washing units and the injection thereof from those of a lower surface washing unit, and rotational movements of these nozzles on their own axes and orbital movements thereof. These nozzles can be applied to various modes of washing operations, such as a simultaneous washing operation and/or staggered washing operation, and are selected considering the shape, sizes and washing accuracy of the work. A structure (not shown) in which the table is rotated can also be employed.

At a point in time at which the washing of the work in the first position is completed, the transfer unit is operated to transfer the work and table to a washing position, and stopped in a subsequent predetermined position (second position) by utilizing a detecting device, such as a limit switch. After the work and table are stopped, the work is dried in all directions thereof by utilizing the injection of air from the nozzles of the upper surface washing unit, those of the side surface washing units and those of the lower surface washing unit, and rotational movements of these nozzles on their own axes and orbital movements thereof. These nozzles can be applied to various modes of drying operations, such as a simultaneous drying and/or a staggered drying operation, and are selected considering the shape, sizes and a washing accuracy of the work. Other structures and operations are the same as in the above-described example.

At the point in time at which the drying operation in the second position is completed, the transfer unit is operated to move the work and table to a carry-in position, and stopped in a first predetermined position (first position) by utilizing a detecting device, such as a limit switch. The work in this stopping position and finished being washed and dried is taken out. The operations to be thereafter carried are the same as in the above-described example.

The above is a description of a structure in which the first position discriminates the second position therefrom, and in which the washing of the work and the drying thereof are done in the first position and second position respectively. A simple type structure in which the washing and drying of the work is done in a predetermined shifted position (for example, the first position mentioned above) can also attain the same effects.

Embodiment

An example of the treatment method according to the present invention will now be described.

The present invention relates to a work washing apparatus of which main constituent elements are a transfer unit A for controlling forward and rearward movements of a work W, a table B formed so that water and/or air moved by this transfer unit A can pass the table B, an upper surface washing unit C provided on an upper surface of the transfer-unit A and having nozzles which make planetary movements by utilizing rotational movements of the nozzles on their own axes and orbital movements thereof, side surface washing units D, D (a description of one side surface washing unit D will be given) provided on both side surfaces of the transfer unit A and having nozzles which make planetary movements by utilizing rotational movements of the nozzles on their own axes and orbital movements thereof, a lower surface washing unit E provided on a lower surface of the transfer unit A and having nozzles which make planetary movements by utilizing rotational movements of the nozzles on their own axes and orbital movements thereof, and devices F1, F2 for supplying water and/or air to the nozzles.

The transfer unit A includes sprockets 1, 2 supported on a frame H, and chains 3, 4 passed around the sprockets 1, 2, and either one of the sprockets 1, 2 is driven via a motor (an example of a driving unit) (not shown). To stop the chains 3, 4 in predetermined positions, electric devices, for example, limit switches or relays (not shown) are utilized.

The table B is a device on which a work W is placed. The table B is formed so that the table B has a clearance 5 so as to enable the washing of the upper and lower surfaces of the work W to be done, and the water and air to be passed therethrough. In this example, a knitted member is utilized as the table. This table B is provided on the chains 3, 4 in the transfer unit A. Therefore, the table is moved in accordance with the movements of the chains 3, 4, and stopped in the first and second positions.

The upper surface washing unit C is provided on an upper surface of the transfer unit A and having a multiplicity of nozzles (which shall be upper surface washing nozzles 6 to 6*n*) which make planetary movements by utilizing the rotations of the nozzles on their own axes and orbital movements thereof. This upper surface washing unit C includes a rotatable main shaft 7 provided on the frame H via a bearing, a driving unit (which shall be a motor 8) for controlling the rotation of this main shaft 7, a belt and pulleys (which shall be a transmission unit 9) for transmitting the rotation of the motor 8 to the main shaft 7, a rotary plate 10 mounted on the main shaft 7, a rotary shaft 11 provided vertically on this rotary plate 10, and the driving unit (having a sleeve 1100 extending downward from the frame H, for controlling the rotation of this rotary shaft 11, a spur gear 12 mounted fixedly on the sleeve 1100, and a spur gear 12*a* mounted fixedly on the rotary shaft 11) for controlling the rotary shaft 11. Therefore, the rotation of this rotary shaft 11 is made by the orbital movement thereof made by the rotary plate 10, so that the spur gear 12*a* (which is not rotated) mounted on this rotary shaft 11 is rotated around the axis of the spur gear 12 mounted on the sleeve 1100. The rotary shaft 11 (rotated on its own axis) includes upper surface nozzle links 13 to 13*n* mounted thereon, the driving unit for controlling the rotation of these links 13 to 13*n*, and the nozzles 6 to 6*n* provided on the same links 13 to 13*n*. Accordingly, the orbital movements of the upper surface washing nozzles 6 are made through a path extending from the motor 8→transmission unit 9→main shaft 7→rotary plate 10. The rotations of the upper surface washing nozzles 6 on their own axes are made through a path extending from the motor 8→transmission unit 9→main shaft 7→sleeve 1100, the rotary shaft 11 and spur gears 12, 12*a*→upper surface nozzle links 13 to 13*n*. The rotation of the rotary shaft 11 causes, via a bevel gear 1101 mounted thereon and a bevel gear 1102 meshed with this bevel gear 1101, a horizontal shaft 1104 supported on a mount member 1103 of the rotary plate 10 via a bearing to be rotated, a sprocket 1105 mounted on the horizontal shaft 1104 being thereby rotated. This sprocket 1105 is connected to sprockets in the side surface washing units described later. In this example, the multiplicity of nozzles making planetary movements by utilizing the rotations thereof on their own axes and orbital movements thereof are provided in a paired state, each pair being moved in the same manner.

The side surface washing unit D has a multiplicity of nozzles (which shall be side surface washing nozzles 15 to 15*n*) provided on a side surface of the transfer unit A and making planetary movements by utilizing the movements of the nozzles on their own axes and orbital movements thereof. This side surface washing unit D includes support rods 16 provided on the rotary plate 10 in the upper surface washing unit C, rotary shafts 17 provided on the support rods 16, rotating devices (in this example, the sprockets 1105 on the horizontal shafts 1104 and the sprockets 18 on the rotary shafts 17 provided on the support rods 16 are connected together by chains 19, and the rotations of the sprockets 1105 are transmitted to the sprockets 18 via the chains 19) for controlling the rotation of the rotary shafts 17, side surface nozzle links 20 to 20*n* mounted on the rotary shafts 17, and pairs of side surface washing nozzles 15 to 15*n* provided on the side surface nozzle links 20 to 20*n*. Therefore, the orbital movements of the side surface washing nozzles 15 to 15*n* are made in accordance with the rotation of the rotary plate 10. The rotations of these nozzles 15 to 15*n* on their own axes are made through the horizontal shafts 1104→sprockets 1105→chains 19→sprockets 18→rotary shafts 17→side surface nozzle links 20 to 20*n*.

The lower surface washing unit E is provided on the lower surface of the transfer unit A, and has a multiplicity of nozzles (lower surface washing nozzles 21 to 21*n*) making planetary movements by utilizing the movements of the nozzles on their own axes and orbital movements thereof. This lower surface washing unit E includes a vertical rotatable shaft 22 provided on the frame H, a rotating device (motor 23 in this example) for controlling the rotation of the vertical shaft 22, pulleys 24 to 24*n* (and a belt 25) mounted on an output shaft of this motor 23 and the vertical shaft 22, a rotary plate 26 mounted on the vertical shaft 22, a rotary shaft 27 provided on the rotary plate 26, lower surface nozzle links 28 to 28*n* mounted on this rotary shaft 27, a rotating unit (formed by spur gears 29 to 29*n* mounted on the vertical shaft 22 and rotary shaft 27 in this example) for controlling the rotations of the lower surface nozzle links 28 to 28*n*, and lower surface washing nozzles 21 to 21*n* provided on the lower surface nozzle links 28 to 28*n*. Therefore, the orbital rotations of the lower surface washing nozzles 21 to 21*n* are made through the motor 23→rotating device→vertical shaft 22→lower surface nozzle links 28 to 28*n*. The rotations of the lower surface washing nozzles 21 to 21*n* on their own axes are made through the motor 23→vertical shaft 22→rotating device→lower surface nozzle links 28 to 28*n*.

A device F1 for supplying water from the upper surface washing nozzles 6 to 6*n*, lower surface washing nozzles 21 to 21*n*, side surface washing nozzles 15 to 15*n* (these shall be nozzles N when they are generally referred to) is formed by main constituent elements of a water tank 30, a pump 31, a branch manifold 32 and a rotary valve (not shown), a pipe 33 and various valves 34, and injects the water in the water tank 30 onto a work W by utilizing the nozzles N. Referring to the drawings, a reference numeral 35 denotes a waste water tank, and 36 a filter.

An air supply device F2 is formed by main constituent elements including a compressor 40, a pump 41, a branch manifold 42 and a rotary valve (not shown), a pipe 43 and various valves 44, and injects the air in the compressor 40 onto the work W by utilizing the nozzles N.

The present invention provides a work washing apparatus having a transfer unit for controlling forward and rearward movements of a work, a table provided with water/air pipes used to wash and dry the whole surface of the work moved by the transfer unit, an upper surface washing unit provided on an upper surface of the transfer unit and having upper surface washing nozzles, side surface washing units provided on both side surfaces of the transfer unit and having side surface washing nozzles, a lower surface washing unit provided on a lower surface of the transfer unit and having lower surface washing nozzles, and a device for supplying water and/or air to each nozzle, the upper surface washing unit including a freely rotatable main shaft provided on a frame, a driving unit and a transmission unit for controlling a rotation of the main shaft, a rotary plate mounted on the main shaft, a rotary shaft provided vertically on the rotary plate, a gear mounted on the rotary shaft and a gear mounted on a sleeve fastened to the frame both of which gears are meshed with each other to cause the rotary shaft to be rotated, horizontal shafts provided on the rotary plate, sprockets mounted on the horizontal shafts, upper surface nozzle links mounted on the rotary shaft, the driving device for controlling the rotations of the upper surface nozzle links, and upper surface washing nozzles provided on the upper surface nozzle links, the side surface washing unit including support rods provided on the rotary plate of the upper surface washing unit, rotary shafts provided on the support rods, sprockets connected to the sprockets in the upper surface washing unit, which rotate these rotary shafts, via chains, side surface nozzle links mounted on the rotary shafts, and a pair of side surface nozzles provided on the side surface nozzle links, the lower surface washing unit including a vertical rotatable shaft provided on the frame, a rotating device for controlling a rotation of this vertical shaft, a rotary plate mounted on the vertical shaft, a rotary shaft provided on the rotary plate, lower surface nozzle links mounted on this rotary shaft, a rotating device for controlling a rotation of the lower surface nozzle links, and lower surface nozzles provided on the lower nozzle links.

Therefore, this work washing apparatus has the advantage of washing a work in all directions thereof at substantially the same time by utilizing the transfer unit, which is adapted to control the forward and rearward movements of the work, and a multiplicity of nozzles moved by the transfer unit and provided on the upper, lower and side surfaces thereof; simplifying and miniaturizing the washing apparatus and pipes or facilitating the maintenance and management of the apparatus by utilizing this all-direction washing operation; simplifying and miniaturizing the washing apparatus or facilitating the maintenance and management of the apparatus by providing a multiplicity of nozzles in many directions of the washing apparatus; improving a washing efficiency and attaining the reduction of the work washing time; and attaining the facilitation of the handling of the washing apparatus or meeting an energy saving purpose.

What is claimed is:

1. A work washing apparatus comprising:

a transfer unit for controlling the forward and rearward movements of a work, a table provided with a clearance to enable water and air to be passed therethrough to wash and dry the whole surface of the work moved by the transfer unit, an upper surface washing unit provided on an upper surface of the transfer unit and having upper surface washing nozzles, side surface washing units provided on both side surfaces of the transfer unit and having side surface washing nozzles, a lower surface washing unit provided on a lower surface of the transfer unit and having lower surface washing nozzles, and a device for supplying at least one of water and air to each nozzle, the upper surface washing unit including a freely rotatable main shaft provided on a frame, a driving unit and a transmission unit for controlling a rotation of the main shaft, a rotary plate mounted on the main shaft, a rotary shaft provided vertically on the rotary plate, a gear mounted on the rotary shaft and a gear mounted on a sleeve fastened to the frame both of which gears are meshed with each other to cause the rotary shaft to be rotated, horizontal shafts provided on the rotary plate, sprockets mounted on the horizontal shafts, upper surface nozzle links mounted on the rotary shaft, a driving device for controlling the rotations of the upper surface nozzle links, and upper surface washing nozzles provided on the upper surface nozzle links, each side surface washing unit including support rods provided on the rotary plate of the upper surface washing unit, rotary shafts provided on the support rods, sprockets connected to the sprockets in the upper surface washing unit, which rotate said rotary shafts via chains, side surface nozzle links mounted on the rotary shafts, and a pair of side surface nozzles provided on the side surface nozzle links, the lower surface washing unit including a rotatable vertical shaft provided on the frame, a rotating device for controlling a rotation of said vertical shaft, a rotary plate mounted on the vertical shaft, a rotary shaft provided on the rotary plate, lower surface nozzle links mounted on this rotary shaft, a rotating device for controlling the rotations of the lower surface nozzle links, and lower surface washing nozzles provided on the lower surface nozzle links, wherein said upper surface washing nozzles, said lower surface washing nozzles and said side surface washing nozzles make planetary movements.

* * * * *